US005907957A

United States Patent [19]

Lee et al.

[11] Patent Number: 5,907,957

[45] Date of Patent: Jun. 1, 1999

[54] DISCHARGE PRESSURE CONTROL SYSTEM FOR TRANSPORT REFRIGERATION UNIT USING SUCTION MODULATION

[75] Inventors: Joseph H. Lee, Fayetteville; Martin O. Johnsen, Syracuse, both of N.Y.

[73] Assignee: Carrier Corporation, Syracuse, N.Y.

[21] Appl. No.: 08/997,028

[22] Filed: Dec. 23, 1997

[51] Int. Cl.[6] ..... F25B 41/04

[52] U.S. Cl. ..... 62/217; 62/181; 62/DIG. 17

[58] Field of Search ..... 62/217, 181, 183, 62/184, 228.1, 228.3, DIG. 17, 180

[56] References Cited

U.S. PATENT DOCUMENTS

| | | | |
|---|---|---|---|
| 4,646,964 | 3/1987 | Parker et al. | 236/94 |
| 5,163,301 | 11/1992 | Cahill-O'Brien et al. | 62/217 |
| 5,255,529 | 10/1993 | Powell et al. | 62/181 X |
| 5,259,204 | 11/1993 | McKeown | 62/DIG. 17 |
| 5,309,727 | 5/1994 | Duff et al. | 62/117 |
| 5,369,597 | 11/1994 | Bujak, Jr. | 364/505 |
| 5,454,511 | 10/1995 | Van Ostrand | 236/46 R |
| 5,539,382 | 7/1996 | Duff et al. | 340/555 |
| 5,711,161 | 1/1998 | Gustafson | 62/217 X |

*Primary Examiner*—Harry B. Tanner
*Attorney, Agent, or Firm*—Wall Marjama Bilinski & Burr

[57] ABSTRACT

A compressor discharge pressure control system employed on a container refrigeration unit utilizes a pressure transducer located in the high pressure side of the system and a data processor to control and limit the compressor discharge pressure to a maximum value when the normal condenser pressure controls are inactive. The pressure control system operates the suction modulation valve in a manner that significantly reduces compressor cycling and increases refrigeration system capacity during pull-down periods. The pressure control system also operates during water-cooled operation of a refrigeration system having a water-cooled condenser thereby eliminating the need to provide a water pressure switch in the refrigeration system.

17 Claims, 5 Drawing Sheets

DISCHARGE PRESSURE CONTROL SYSTEM FOR TRANSPORT REFRIGERATION UNIT USING SUCTION MODULATION

BACKGROUND OF THE INVENTION

1. Field of the Invention

This invention relates to transport refrigeration systems. More particularly, this invention relates to a transport refrigeration system that automatically adjusts compressor discharge pressure using a suction modulation valve to reduce compressor cycling and increase pull-down capacity of the transport refrigeration unit.

2. Description of the Prior Art

Container refrigeration systems are known in the art for providing methods of limiting maximum head/condenser pressures. Conventional container refrigeration systems such as that employed in the THINLINE® series of transport refrigeration units manufactured by the Carrier Transicold Division of Carrier Corporation located in Syracuse, N.Y., typically include a condenser pressure control logic or the like to limit and maintain head/condenser pressures to a maximum value. Generally, these machines activate one or more condenser fans in response to an increasing ambient temperature to maintain discharge pressures below a predetermined maximum value in low temperatures. These conventional container refrigeration systems can employ air-cooled condensers and/or water-cooled condensers having some sort of water pressure switch such as a model 20SP117-7 manufactured by Texas Instruments to and/or a high pressure side transducer to help control the aforesaid high head/condenser pressures. It is well known by those skilled in the refrigeration art, that such systems are commonly susceptible to rapid compressor cycling during temperature pull-down periods in order to achieve the necessary refrigeration capacities. This rapid compressor cycling is disadvantageous in that it reduces compressor reliability and creates unwanted constant noise levels that become a nuisance to end users.

Still needed, but not available with transport refrigeration systems presently known in the art is a transport/container refrigeration system that is capable of establishing and maintaining maximum refrigeration system capacity during periods of temperature pull-down without necessitating rapid compressor cycling.

SUMMARY OF THE INVENTION

Accordingly, the present inventive transport refrigeration system provides a structure and method intended to overcome many of the shortcomings and attendant disadvantages of known container/transport refrigeration machines that share problems considered unavoidable within the industry, some of which have been discussed herein above. The present invention surmounts these problems with a radical new structure that combines a data processor with a strategically positioned high side pressure line pressure transducer to improve and optimize refrigeration system capacity during periods of temperature pull-down while requiring only minimal compressor cycling. The refrigeration system constructed according to one preferred embodiment of the present invention comprises a microprocessor or computer implemented device to control the compressor discharge pressure to a maximum value during periods when the condenser system pressure control is inactive, i.e. condenser fans are not running, and/or during periods of water-cooling if the refrigeration system uses a water-cooled condenser.

The preferred device comprises: a data processing device; an input device in communication with the data processing device; an algorithmic software directing the data processing device; and a data storage unit, wherein digitized pressure data can be extracted and supplied to the data processing device such that the data processing device, directed by the algorithmic software, can expand the digitized pressure data and synthesize enhanced data to automatically control suction modulation valve cycling, suction solenoid valve cycling, condenser fan cycling, and/or compressor cycling using the digitized pressure data provided by the high pressure side transducer, and algorithmically defined interrelationships between the digitized pressure data and digitized data provided by suction modulation valve transducers, suction solenoid transducers, condenser fan transducers and compressor transducers.

As used herein, the following words have the following meanings. The word "enhance" means a process of developing refined data by interpreting related data points from an existing data base to generate new data points based on extrapolation, interpolation, modeling, extension, or the like, or a combination thereof to increase the number of data points to include the newly generated data points. In this way, the existing data base can be "enhanced". The word "synthesize" means to create an enhanced model from a set of digitized data points. As used herein in relation to the use of data points from digitized transducer information, to "synthesize" a control model means to create a control model base including new data points created by a process wherein existing data points from the existing data base are "enhanced" and an "enhanced" model is created. The words "algorithmic software" means an algorithmic program used to direct the processing of data by a computer or data processing device. The word "extracting" describes a device-implemented mathematical process or software directed computer process of selecting data from a given set of data points based on a predefined criteria for selecting data. "Data extraction" is a software directed or device-implemented process of selecting data from a given set of data points based on a predefined criteria for selection among the set. The word "expanding" means creating new data points based on a parameter or parameters consistent with a selected group of existing data points. The words "software implemented" as used herein refer to the use of a software program on a particular computer system. Similarly, the words "computer implemented device" refer to the use of a computer system on a particular device. The words "discrete data" as used herein are interchangeable with "digitized data", and "digitized data" as used herein means data which are electromagnetically stored in the form of singularly isolated, discontinuous data or digits. The words "data processing device" as used herein refer to a CPU and an interface system. The interface system provides access to the CPU such that data could be entered and processed by the data processing device.

A feature of the present invention is the provision of a container/transport refrigeration system that utilizes an associated logic to control the aforesaid compressor discharge pressure during periods of water-cooled operation as well, thereby eliminating the need a for water pressure switch to be installed in a refrigeration system that has a water-cooled condenser.

Another feature of the present invention is the provision of a container/transport refrigeration system having reduced periods of compressor cycling, thereby increasing user perception of system operation and capability.

Yet another feature of the present invention is the provision of a container/transport refrigeration system having multiple interrelated automated pressure control systems, thereby providing increased system reliability and reduced system maintenance.

From the foregoing, it is clear that the present inventive transport refrigeration system performance is greatly enhanced over existing systems. Other features of the present inventive apparatus include ease of use, enhanced serviceability, maintainability, upgradability, and enhanced expansion and diagnostics capability.

BRIEF DESCRIPTION OF THE DRAWINGS

Other objects and features of the present invention and many of the attendant advantages of the present invention will be readily appreciated as the same becomes better understood by reference to the detailed description when considered in connection with the accompanying drawings in which like reference numerals designate like parts throughout the figures thereof and wherein.

While the above-identified drawing figures set forth alternative embodiments, other embodiments of the present invention are also contemplated, as noted in the discussion. In all cases, this disclosure presents illustrated embodiments of the present invention by way or representation and not limitation. Numerous other modifications and embodiments can be devised by those skilled in the art which fall within the scope and spirit of the principles of this invention.

DETAILED DESCRIPTION OF THE PREFERRED EMBODIMENT(S)

The preferred embodiments described herein as follows address the long felt need by those in the container/transport refrigeration industry to provide a highly efficient refrigeration system capable of controlling and limiting the compressor discharge pressure to a maximum value during periods when the associated condenser pressure control system logic is inactive. Conventional condenser pressure control logic is typically limited to condenser fan control mechanisms, devices and methods. In accordance with the present invention, the preferred embodiments described herein can readily and reliably function without the need for a water pressure switch installed anywhere in the refrigeration system, even when the refrigeration system employs a water-cooled condenser unit.

Figure 1:
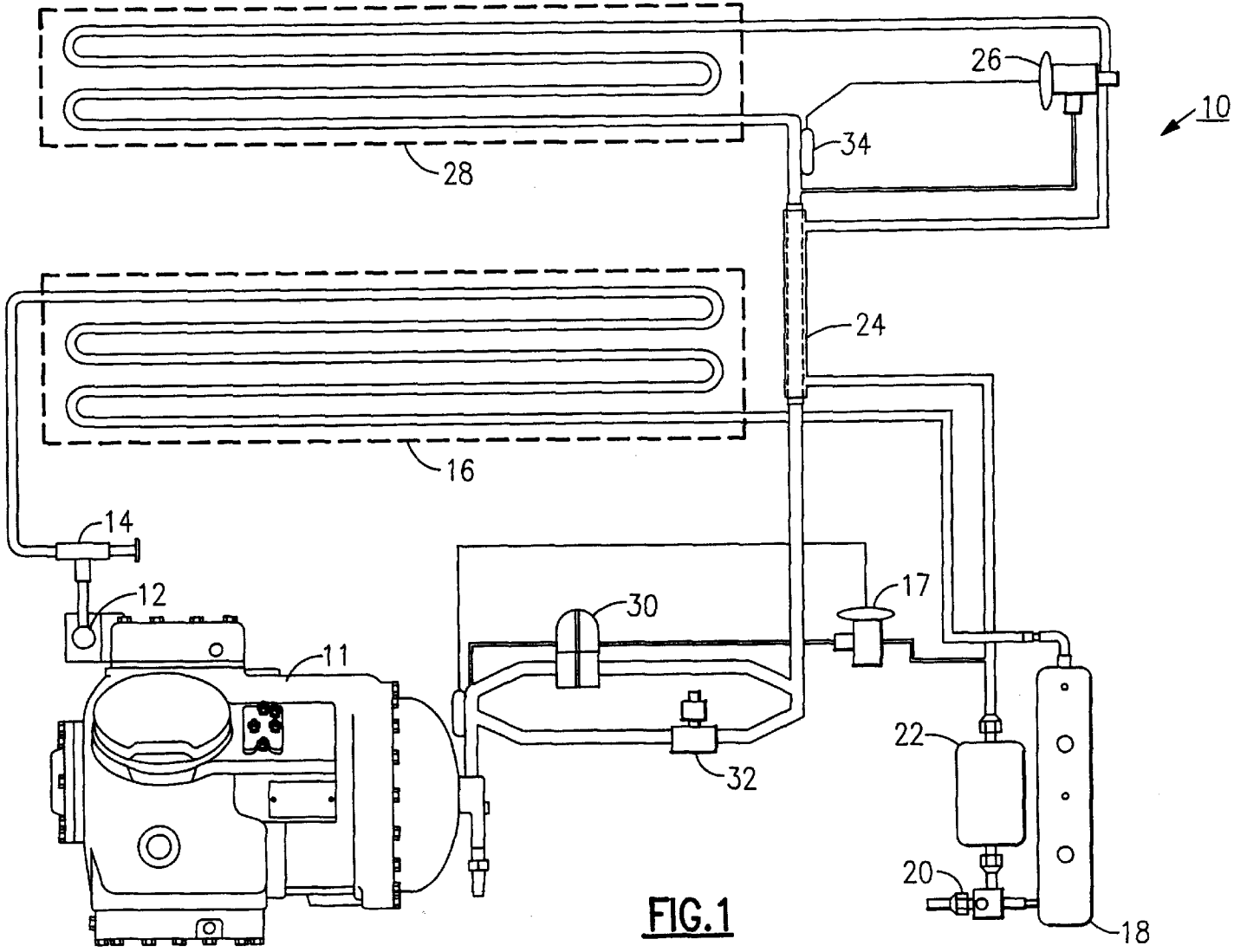
FIG. 1 is a simplified schematic diagram illustrating a container refrigeration system having a pressurized receiver familiar to those skilled in the art of transport refrigeration.

FIG. 1 is a simplified schematic diagram illustrating one embodiment of a container refrigeration system 10 having a pressurized receiver 18 familiar to those skilled in the art of container/transport refrigeration systems. Operation of the refrigeration system can best be understood by starting at the compressor 11, where the suction gas (refrigerant) is compressed to a higher temperature and pressure. When operating with the air-cooled condenser 16, the gas flows through the compressor discharge service valve 12 into a pressure regulator valve 14 that is normally open. The pressure regulator valve 14 restricts the flow of refrigerant to maintain a predetermined minimum discharge pressure. Refrigerant gas then moves into the air-cooled condenser 16. Air flowing across a group of condenser coil fins and tubes cools the gas to its saturation temperature. By removing latent heat, the gas condenses to a high pressure/high temperature liquid and flows to a receiver 18 that stores additional charge necessary for low temperature operation. Conventional condenser pressure control transducers/sensors (enumerated as 320 in FIG. 3) can be installed within the receiver 18 or can be located at any point on the high pressure side of the refrigeration system 10 to adapt the system 10 for use with pressure control logic such that high side pressures can be limited and maintained. The words "high pressure side", as used herein refer to that portion of the refrigeration system between the compressor discharge service valve 12 and the thermostatic expansion valve 26. From the receiver 18, the liquid refrigerant continues through a manual liquid line valve 20, a filter-drier 22 (that keeps refrigerant clean and dry), and a heat exchanger 24 that increases subcooling of liquid refrigerant to a thermostatic expansion valve 26. As the liquid refrigerant passes through the orifice of the expansion valve 26, some of it vaporizes into a gas (flash gas). Heat is absorbed from the return air by the balance of the liquid, causing it to vaporize in the evaporator coil 28. The vapor then flows through a suction modulation valve 30 (and a suction solenoid valve 32 under some conditions) back to the compressor 11. A thermostatic expansion valve bulb 34 on the suction line near the evaporator coil 28 outlet controls the thermostatic expansion valve 26, maintaining a constant superheat at the coil outlet regardless of load conditions, except at abnormally high container temperatures such as during pulldown (valve at maximum operating pressure condition).

Figure 2:
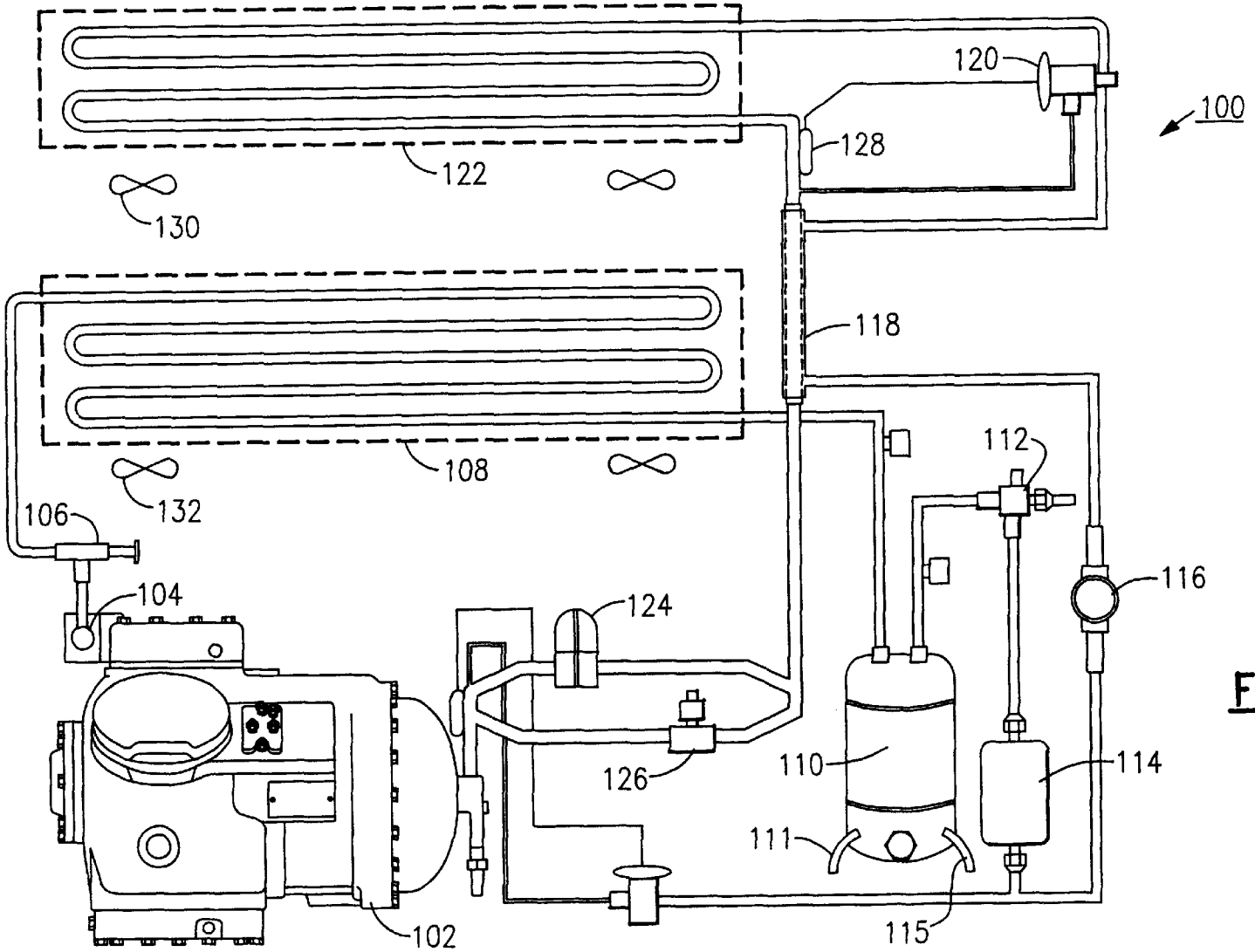
FIG. 2 is a simplified schematic diagram illustrating a container refrigeration system having a water-cooled condenser familiar to those skilled in the art of transport refrigeration.

FIG. 2 is a simplified schematic diagram of a container refrigeration system 100 having a water-cooled condenser 110 familiar to those skilled in the art of transport refrigeration. Operation of the refrigeration system 100 is similar to that described herein above for the container refrigeration system 10 having a receiver 18. Therefore, operation of the refrigeration system 100 will be explained herein below only with regard to details that are different between the two refrigeration systems 10, 100 to preserve brevity and clarity. For example, as refrigerant gas is discharged from the air-cooled condenser 108, it moves through a water-cooled condenser 110, having a water inlet 111 and a water outlet 115 where it flows across a water chilled coiled tube bundle (not shown). The refrigerant gas is cooled to its saturation temperature and exits the water-cooled condenser 110 as a high pressure/saturated liquid. From the water-cooled condenser 110, operation is as described herein above for the container refrigeration system 10. Generally, the water-cooled condenser 110 will have a water pressure switch (not shown) coupled to its water supply line to activate air-cooled condensing when water is not being supplied via water inlet 111.

With continued reference to FIG. 2, the suction solenoid valve 126 can be operated in its fully open position where it allows the low pressure refrigerant vapor exiting the evaporator unit 122 to flow unrestricted into the compressor unit 102. The suction solenoid valve 126 can also be operated in its fully closed position where it restricts the compressor unit 102 input (suction) line to prohibit the flow of low pressure refrigerant vapor. It can readily be appreciated that operating the suction solenoid valve 126 in its fully closed position will prevent the compressor unit 102 from receiving a continuous source of low pressure refrigerant vapor to be compressed, thereby preventing the compressor unit 102 from injecting new compressed hot refrigerant vapor into the air-cooled condenser unit 108. The reduced supply of compressed hot refrigerant vapor discharged by the compressor unit 102 will allow the condenser units 108, 110 more time to cool and liquefy the existing compressed hot refrigerant vapor that is presently flowing through the condenser coils. As the compressed hot refrigerant vapor continues to be liquefied, the compressor unit 102 discharge line continues to lose its existing compressed hot refrigerant vapor supply. This process then yields a lower pressure within the compressor unit discharge line. Those skilled in the art can appreciate that the aforesaid lower pressure results from the well known mathematical relationship $P_1V_1/T_1=P_2V_2/T_2$, where P, V and T represent pressure, volume and temperature respectively in a closed system. In like fashion, the suction modulation valve 124 can be operated in a fully closed or open position to restrict the supply of low pressure refrigerant vapor to the compressor unit 102. However, the suction modulation valve 124 can also be selectively operated in any number of partially closed or partially open positions to more precisely control and limit the amount of low pressure refrigerant vapor that is supplied to the input of the compressor unit 102. Remembering now the relationship $P_1V_1/T_1=P_2V_2/T_2$ referenced herein above, it can easily be seen that the cool liquid refrigerant having a lower temperature $T_2$ will now be contained within the closed fixed volume system where $v_1=V_2$, but now also having a lower pressure $P_2$. The present inventors realized that liquid line pressures can also be reduced simply by providing condenser unit fan(s) 132 to further reduce the compressed hot refrigerant vapor temperature during periods when the condenser fan(s) 132 are normally shut down, i.e. periods when the normal condenser unit pressure controls are inactive. The present inventors further realized that liquid line pressures in a transport refrigeration system 100 that has condenser water cooling capability could also be reduced simply by using the same principles described herein above during periods of condenser water cooling, thereby eliminating the necessity to employ a water pressure switch to maintain a safe water pressure level for the refrigeration system 100.

Figure 3:
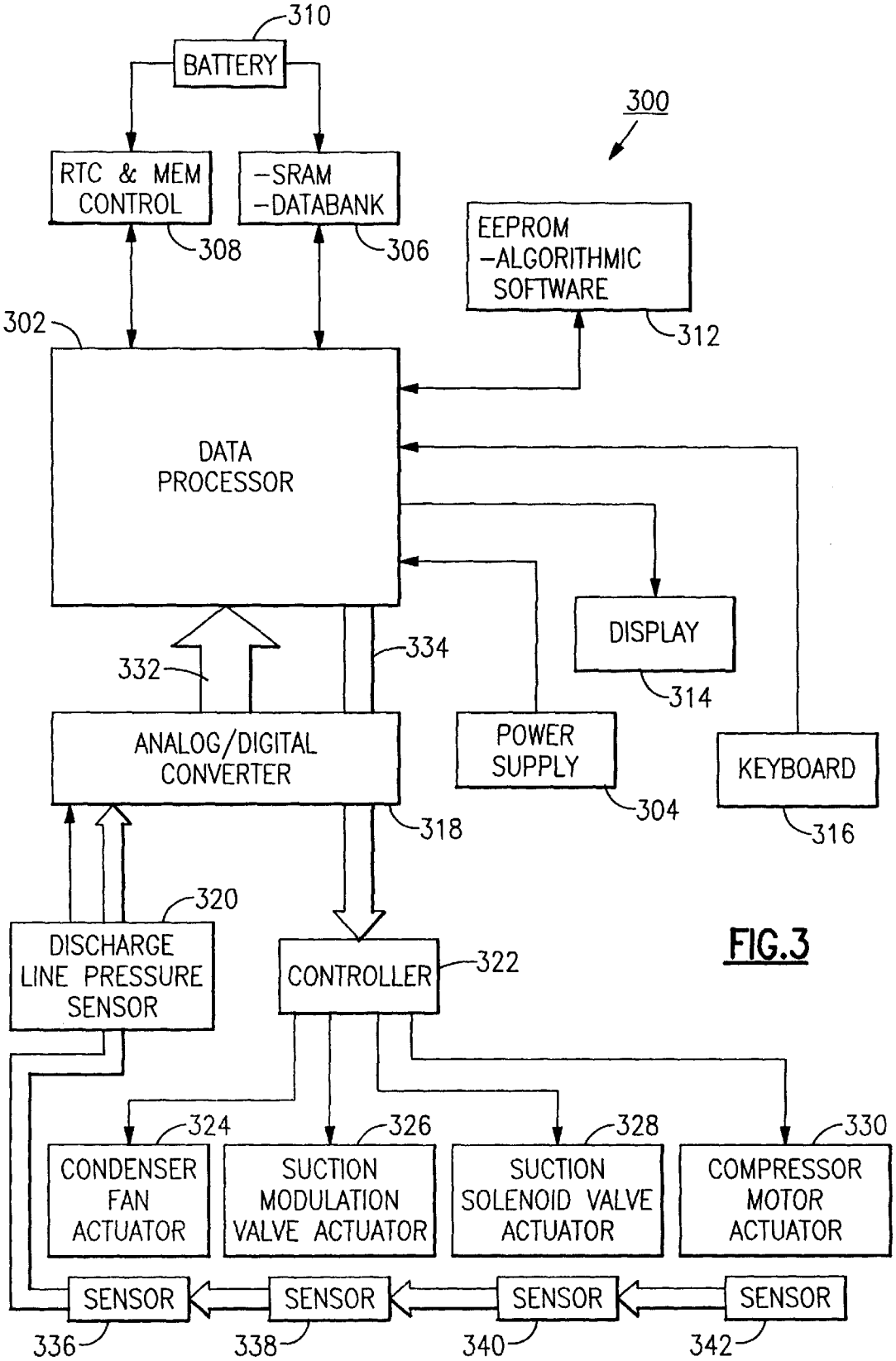
FIG. 3 is a block diagram illustrating a control system that is suitable for use with the transport refrigeration systems shown in FIGS. 1 and 2.

Looking now at FIG. 3, a block diagram illustrates a control system 300 that is suitable for use with the transport refrigeration systems 10 and 100 shown in FIGS. 1 and 2 respectively, to control the compressor 11, 102 discharge pressure. To preserve clarity, the control system will be described herein below with reference to the refrigeration system 100 shown in FIG. 2. It shall be readily understood however that the control system 300 will function equally well with the refrigeration system 10 shown in FIG. 1. The control system 300 is seen to include a data processor 302 receiving signals from and analog-to-digital converter 318. The analog-to-digital converter 318 digitizes signals from a compressor discharge line pressure sensor 320 strategically placed in the refrigeration system 100 liquid line. As will be explained in detail herein below, the data processor 302 selectively controls the condenser fan(s) 132, the suction modulation valve 124, the suction solenoid valve 126, and/or the compressor/motor unit 102 based upon the digitized values read from the compressor discharge line pressure sensor 320. Predetermined pressure values are stored in a memory unit 312 along with the algorithmic software (enumerated as 400 in figures 4A,B). Most preferably, the predetermined pressure values and the algorithmic software 400 is stored in a PROM such as an EEPROM familiar to those skilled in the computer arts. It will readily be appreciated that the present invention is not limited to the exact embodiment shown in FIG. 3 however, and that many other types of memory units can also be used to accomplish the present invention. Most preferably, the control system 300 has a real time clock and memory control unit 308 as well as a memory unit 306 having a battery 310 power back-up capability to ensure the integrity of data bases stored in the memory unit 306 during periods of lost power to the refrigeration system 100. The aforesaid digitized discharge line pressure sensor 320 data is then stored in the memory unit 306 for processing by the data processor 302 in accordance with instructions prescribed by the algorithmic software 312. Control system 300 is also seen to have a power supply 304 for providing power to the data processor 302. A display 314 and a keyboard (keypad) 316 or like device are provided to supply visual pressure readings and allow an operator the ability to manually access and modify the control system 300 operating parameters if desired or necessary. Thus, a system 300 operator can easily customize the system set points, for example, to operate during precisely defined periods when the standard condenser pressure control logic is inoperative or during precisely defined periods when the water-cooled condenser 110 is being water-cooled as stated herein before.

A controller unit 322 is seen operatively coupled via a data bus 334 to a predetermined set of actuators/transducers 336, 338, 340, 342. The present inventors found that a combination of actuators including a condenser fan actuator 324, a suction modulation valve actuator 326, a suction solenoid valve actuator 328 and a compressor motor actuator 330 provided workable results for the present invention. As described herein above, strategically operating one or more of the actuators according to one preferred embodiment of the present invention will yield the desired result of accurately and precisely controlling the compressor 102 discharge pressure to a maximum value using the data processor 302 control when the standard condenser pressure control logic is inoperative or not working, or when the system 100 is in its water-cooled mode of operation.

Figure 4A:
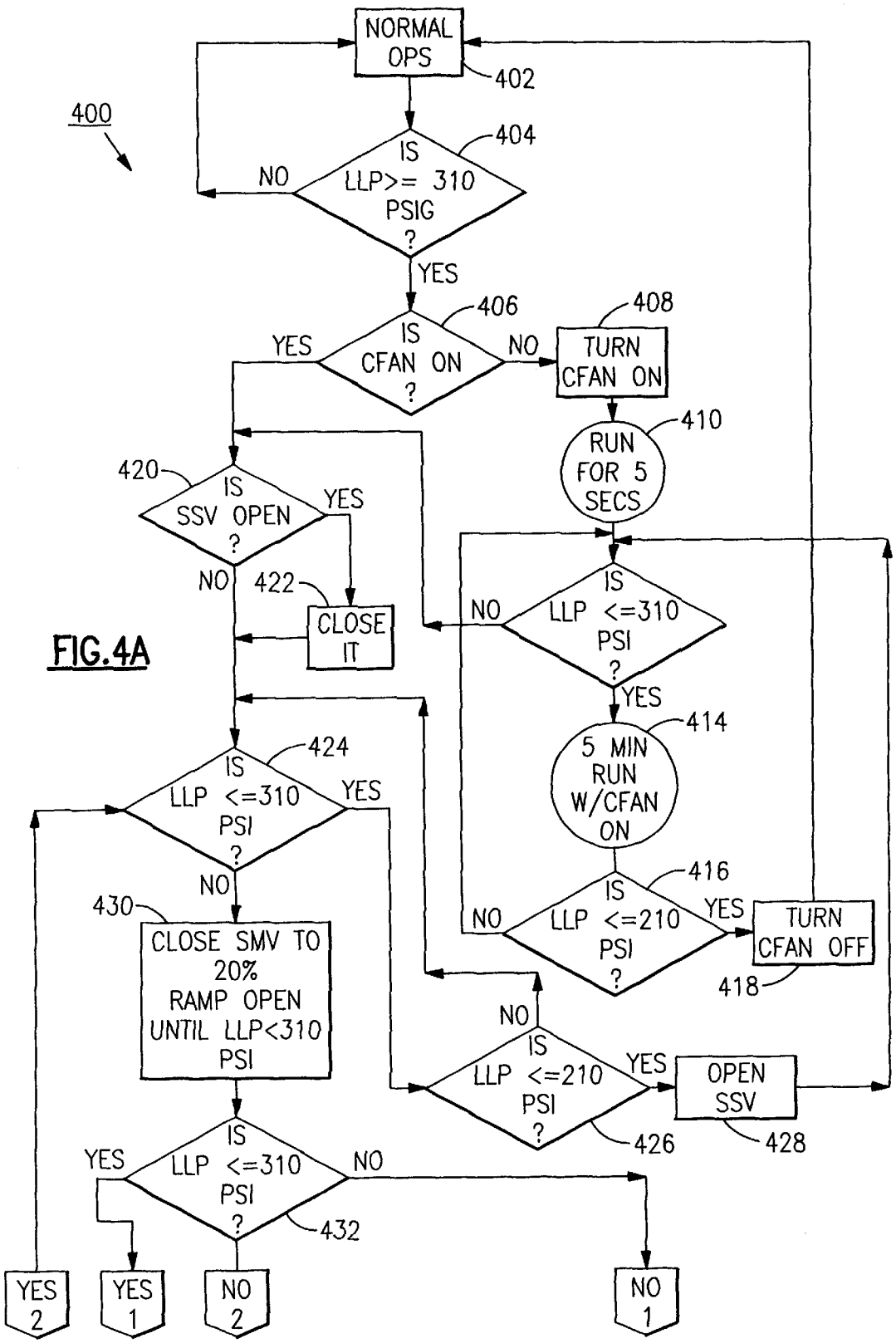
FIGS. 4A, B illustrate an algorithmic software in accordance with one embodiment of the present invention and that is suitable for use with the control system shown in FIG. 3 and the transport refrigeration systems shown in FIGS. 1 and 2.

FIGS. 4A, B illustrate an algorithmic software 400 in accordance with one embodiment of the present invention and that is suitable for use with the control system 300 shown in FIG. 3 and the transport refrigeration systems 10, 100 shown in FIGS. 1 and 2 respectively. As stated herein before, the purpose of the algorithmic software 400 is to control and limit the compressor 102 discharge pressure to a maximum value with use of a data processor 302 during periods when the normal refrigeration system compressor pressure controls are inactive. In general, the data processor 302 is combined with one or more sensors/transducers 320 to sense the refrigerant system 100 liquid line pressure and selectively initiate one or more actions when the aforesaid liquid line pressure is above a preset limit. For example, the data processor 302 can turn the condenser fan(s) 108 on and/or off, close and/or open the suction solenoid valve 126, close and/or open the suction modulation valve 124, and/or turn the compressor 102 on and/or off. When the liquid line pressure drops below the preset limit, the data processor 302 will back up one step. If the liquid line pressure continues to remain below the preset limit for a predefined period of time, it will then back up another step. This process will continue until the normal refrigeration system control sequence is attained.

With reference now to FIG. 4A, it can be seen that the aforesaid process control begins with a refrigeration system 100 that is operating in its normal mode as depicted in block 402. During operation of the refrigeration system 100, the compressor 102 discharge pressure is monitored via control system 300 to determine if the liquid line pressure is equal to or greater than 310 psi as depicted in block 404. The present invention is not so limited however, and it shall be understood that other liquid line pressure limits can just as well be used to accomplish the present inventive method of controlling compressor 102 discharge pressures. If the liquid line pressure is less than 310 psi, the control system 300 does nothing and normal refrigeration system 100 operation is allowed to continue. If the liquid line pressure is found to be equal to or greater than 310 psi, the control system 300 then proceeds to make a determination whether the condenser fan(s) 108 are on as illustrated in block 406. This determination is accomplished when the data processor 302 reads the digital data provided by the condenser fan sensor 336 via the analog/digital converter 318. If the condenser fan(s) 108 are found to be off, then the control system 300 proceeds to turn on the condenser fan(s) 108 as depicted in block 408. The condenser fan(s) 108 are then allowed to run for five seconds at which time the liquid line pressure is again examined to determine if the liquid line pressure is equal to or less than 310 psi as illustrated in blocks 410 and 412. If, as depicted in block 406, the condenser fan(s) 108 are on, or alternatively, if the liquid line pressure is found to be greater than 310 psi as depicted in block 412, then the control system 300 commences to make a determination whether the suction solenoid valve 126 is open as illustrated in block 420. As shown in block 420, if the suction solenoid valve 126 is found to be in its closed position, the control system 300 will then commence to close the suction solenoid valve 126 as shown in block 422. If the condenser fan(s) 108 have been activated as a result of a liquid line pressure equal to or exceeding 310 psi, and running the condenser fan(s) 108 for a predetermined amount of time does not lower the liquid line pressure to 210 psi or less, then the condenser fan(s) 108 are allowed to run continuously until such condition is finally achieved as depicted in blocks 412, 414 and 416. When the liquid line pressure drops to 210 psi or less, the control system 300 turns off the condenser fan(s) 108 as illustrated in block 418, and the refrigeration system 100 is allowed to resume its normal operation as shown in block 402 of FIG. 4A.

Figure 4B:
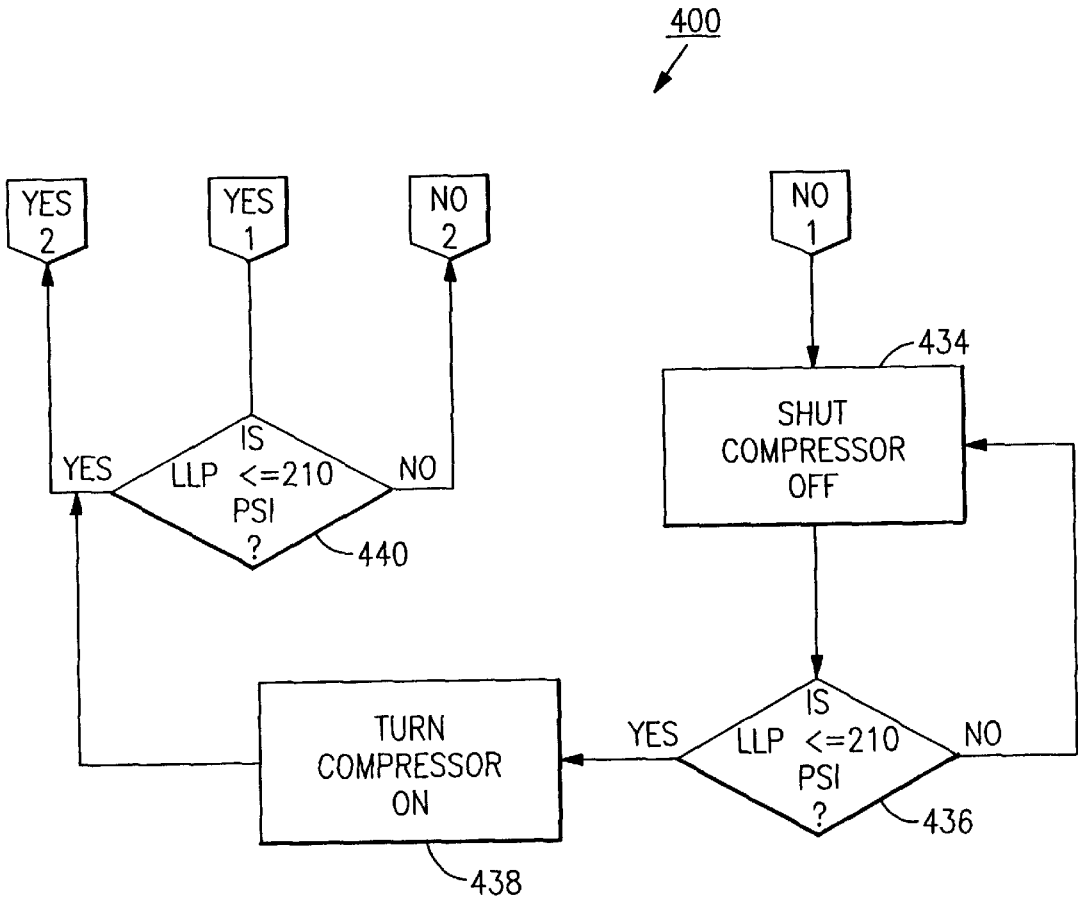

With continued reference to FIGS. 2, 3 and 4A, the control system 300 will commence to read the liquid line pressure immediately after closing the suction solenoid valve 126. As shown in blocks 424, 426 and 428, the control system 300 will proceed to reopen the suction solenoid valve 126 if and when the liquid line pressure finally reaches 210 psi or less. If closing the suction solenoid valve 126 does not immediately lower the liquid line pressure to 310 psi or less, the control system 300 commences to also close the suction modulation valve 124 as illustrated in block 430. As shown in block 430, the suction modulation valve 124 is then incrementally ramped open by the control system 300 in twenty percent increments until the liquid line pressure is below 310 psi as determined by reading the signals provided by the suction modulation valve sensor 338. It shall be understood that the present invention is not so limited however, and that the suction modulation valve 124 can just as well be incrementally opened in steps other than the twenty percent steps referenced herein above to accomplish the present inventive method. If closing both the suction solenoid valve 126 and the suction modulation valve 124 do not lower the liquid line pressure to 310 psi or less, then the control system 300 commences to also shut off the compressor 102 as shown in blocks 432 and 434, illustrated in FIGS. 4A and 4B respectively. With reference now to FIG. 4B, the control system 300 then commences to determine if the liquid line pressure has dropped to 210 psi or less as illustrated in block 436. If the liquid line pressure remains above 210 psi, the compressor 102 is kept in its off mode as shown. If the liquid line pressure drops to 210 psi or less, then the compressor 102 is again turned on as shown in block 438. Immediately after turning the compressor 102 back on as shown in block 438, the liquid line pressure is again examined to ensure that the liquid line pressure is still at or below 210 psi as illustrated in block 440. Similarly, the present invention is not so limited or restricted to providing working results related to sensing liquid line pressures of 210 psi. It shall be understood the foregoing pressure values of 310 psi and 210 psi have been found by the present inventors to provide the best working results, and that other discrete pressure values will also work to implement the present inventive method. If the liquid line pressure rises to 310 psi or more, then the compressor 102 is again shut off and the compressor 102 cycling process is repeated as illustrated in FIG. 4B. If, prior to shutting off the compressor 102, the liquid line pressure is found to be less than 310 psi as shown in block 432 of FIG. 4A, then the control system 300 makes a subsequent determination as to whether the liquid line pressure is at or below 210 psi as shown in block 440 of FIG. 4B. If the liquid line pressure is at or below 210 psi, then the control system 300 proceeds to reopen the suction solenoid valve 126 as represented in blocks 424, 426 and 428 of FIG. 4A. The control sequence then proceeds to back up its previous sequence of steps until normal system 100 operation is attained as referenced herein above.

Having thus described the preferred embodiments in sufficient detail as to permit those of skill in the art to practice the present invention without undue experimentation, those of skill in the art will readily appreciate other useful embodiments within the scope of the claims hereto attached. For example, although the present invention has been described as useful in transport refrigeration systems, those of skill in the art will readily understand and appreciate that the present invention has substantial use and provides many benefits in other types of refrigeration systems as well. In general, the refrigeration industry would find the present invention useful in achieving reliable and efficient cooling for those products where high standards must be maintained and energy waste must be eliminated to preserve resources.

In view of the foregoing descriptions, it should be apparent that the present invention represents a significant departure from the prior art in construction and operation. However, while particular embodiments of the present invention have been described herein in detail, it is to be understood that various alterations, modifications and substitutions can be made therein without departing in any way from the spirit and scope of the present invention, as defined in the claims which follow.

We claim:

1. A method of operating a refrigeration system having high and low pressure sides, a data processor, a memory unit, a condenser fan, a suction solenoid valve, a suction modulation valve and a compressor, said method comprising the steps of:

providing a high pressure sensor in the high pressure side of the refrigeration system;

storing high pressure side data retrieved from the high pressure sensor in the memory unit;

turning the condenser fan on when the high pressure side data is greater than a first predetermined value and the condenser fan is simultaneously off;

closing the suction solenoid valve when the high pressure side data is greater than the first predetermined value and the suction solenoid valve is simultaneously open and the condenser fan is simultaneously on;

closing the suction modulation valve and ramping the suction modulation valve open in predetermined increments when the high pressure side data is greater than the first predetermined value and the suction solenoid valve is simultaneously closed and the condenser fan is simultaneously on; and shutting the compressor off when the high pressure side data is greater than the first predetermined value and the suction modulation valve is simultaneously at least partially open and the suction solenoid valve is simultaneously closed and the condenser fan is simultaneously on.

2. The method of claim 1 further comprising the step of turning the compressor on when the high side pressure data is less than a second predetermined value and the suction modulation valve is simultaneously at least partially open and the suction solenoid valve is simultaneously closed and the condenser fan is simultaneously running.

3. The method of claim 2 further comprising the step of opening the suction solenoid valve when the high side pressure data is less than the second predetermined value and the condenser fan is simultaneously running.

4. The method of claim 3 further comprising the step of turning the condenser fan off when the high side pressure data is less than the second predetermined value and the suction solenoid valve is simultaneously open.

5. A refrigeration system comprising:

a compressor having a discharge port coupled to a high pressure side of the refrigeration system, and further having a suction port coupled to a low pressure side of the refrigeration system;

a pressure transducer coupled to a predetermined portion of the high pressure side of the refrigeration system;

a suction solenoid valve coupled to a predetermined portion of the low pressure side of the refrigeration system;

a suction modulation valve coupled to a predetermined portion of the low pressure side of the refrigeration system;

a condenser fan operatively coupled to the refrigeration system; and a control system in communication with the pressure transducer, the condenser fan, the suction solenoid valve, the suction modulation valve, and the compressor, the control system comprising:

a data processor;

a data input device in communication with the data processor;

an algorithmic software directing the data processor; and a data storage unit, wherein discrete data associated with the pressure transducer, the condenser fan, the suction solenoid valve, the suction modulation valve and the compressor is stored and supplied to the data processor such that the data processor, directed by the algorithmic software, can control operation of the condenser fan, the suction solenoid valve, the suction modulation valve and the compressor using the discrete data and algorithmically defined interrelationships between the data associated with the pressure transducer, the condenser fan, the suction solenoid valve, the suction modulation valve and the compressor such that a predetermined maximum pressure level can be maintained within the high pressure side of the refrigeration system.

6. The refrigeration system of claim 5 further comprising a refrigerant receiver coupled to the high pressure side of the refrigeration system.

7. The refrigeration system of claim 6 wherein the pressure transducer is operatively coupled to the refrigerant receiver.

8. The refrigeration system of claim 7 wherein the predetermined maximum pressure level is about 310 psi.

9. A refrigeration system comprising:

a compressor having a discharge port coupled to a high pressure side of the refrigeration system, and further having a suction port coupled to a low pressure side of the refrigeration system;

pressure sensing means coupled to a predetermined portion of the high pressure side of the refrigeration system for sensing a pressure level defined by the compressor;

gating means coupled to a predetermined portion of the low pressure side of the refrigeration system for gating a flow of refrigerant supplied to the compressor from the low pressure side of the refrigeration system;

modulating means coupled to a predetermined portion of the low pressure side of the refrigeration system for modulating a flow of refrigerant supplied to the compressor from the low pressure side of the refrigeration system;

a first condenser coupled to the high pressure side of the refrigeration system;

cooling means operatively coupled to the refrigeration system for cooling the condenser; and a control system in communication with the pressure transducer, the cooling means, the gating means, the modulating means, and the compressor, the control system comprisingprocessorata procesor;

a data input device in communication with the data processor;

an algorithmic software directing the data processor; and a data storage unit, wherein discrete data associated with the pressure transducer, the condenser cooling means, the gating means, the modulating means and the compressor is stored and supplied to the data processor such that the data processor, directed by the algorithmic software, can control operation of the condenser cooling means, the gating means, the modulating means and the compressor using the discrete data and algorithmically defined interrelationships between the data associated with the pressure transducer, the condenser cooling means, the gating means, the modulating means and the compressor such that a predetermined maximum pressure level can be maintained within the high pressure side of the refrigeration system.

10. The refrigeration system of claim 9 wherein the condenser cooling means comprises at least one condenser fan.

11. The refrigeration system of claim 9 wherein the condenser cooling means comprises a liquid.

12. The refrigeration system of claim 10 further comprising a refrigerant receiver coupled to the high pressure side of the refrigeration system.

13. The refrigeration system of claim 11 further comprising a refrigerant receiver coupled to the high pressure side of the refrigeration system.

14. The refrigeration system of claim 12 wherein the pressure transducer is operatively coupled to the refrigerant receiver.

15. The refrigeration system of claim 13 wherein the pressure transducer is operatively coupled to the refrigerant receiver.

16. The refrigeration system of claim 14 wherein the predetermined maximum pressure level is about 310 psi.

17. The refrigeration system of claim 15 wherein the predetermined maximum pressure level is about 310 psi.

* * * * *